US012082612B2

(12) United States Patent
Fursa

(10) Patent No.: US 12,082,612 B2
(45) Date of Patent: Sep. 10, 2024

(54) DEVICE ASSEMBLY METHOD AND DEVICE MANUFACTURED ACCORDING TO SUCH METHOD

(71) Applicant: Philip Morris Products S.A., Neuchatel (CH)

(72) Inventor: Oleg Fursa, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 458 days.

(21) Appl. No.: 17/611,345

(22) PCT Filed: May 12, 2020

(86) PCT No.: PCT/EP2020/063184
§ 371 (c)(1),
(2) Date: Nov. 15, 2021

(87) PCT Pub. No.: WO2020/229465
PCT Pub. Date: Nov. 19, 2020

(65) Prior Publication Data

US 2022/0225676 A1 Jul. 21, 2022

(30) Foreign Application Priority Data

May 16, 2019 (EP) ..... 19175003

(51) Int. Cl.
*A24F 40/42* (2020.01)
*A24F 40/465* (2020.01)
(Continued)

(52) U.S. Cl.
CPC ..... *A24F 40/42* (2020.01); *A24F 40/465* (2020.01); *A24F 40/51* (2020.01); *A24F 40/60* (2020.01); *A24F 40/70* (2020.01)

(58) Field of Classification Search
CPC ..... A24F 40/42; A24F 40/70; A24F 40/465; A24F 40/51; A24F 40/60
(Continued)

(56) References Cited

U.S. PATENT DOCUMENTS 5,878,752 A * 3/1999 Adams ..... A24F 40/465 131/194
9,408,416 B2 * 8/2016 Monsees ..... G08B 5/36
(Continued)

FOREIGN PATENT DOCUMENTS

DE 196 16 917 A1 10/1997
JP 2019-506894 A 3/2019
(Continued)

OTHER PUBLICATIONS

Combined Russian Office Action and Search Report issued Sep. 25, 2023 in Russian Patent Application No. 2021136066/03 (with English Translation), 12 pages.
(Continued)

*Primary Examiner* — Gary F Paumen
(74) *Attorney, Agent, or Firm* — Oblon, McClelland, Maier & Neustadt, L.L.P.

(57) ABSTRACT

An aerosol-generating system is provided, including: an aerosol-generating device configured to heat an aerosol-forming substrate; and an exterior sleeve, the device including a device housing and a plurality of internal components contained within an interior space enclosed by the housing, the housing including an external surface and at least one bent or bendable portion, bent or bendable into or towards the interior space to interact with one of the internal components, and the exterior sleeve covering the at least one bent or bendable portion. A kit including the aerosol-gen-
(Continued)

erating device and at least one exterior sleeve, and a method of manufacturing an aerosol-generating system, are also provided.

15 Claims, 8 Drawing Sheets

(51) Int. Cl.
*A24F 40/51* (2020.01)
*A24F 40/60* (2020.01)
*A24F 40/70* (2020.01)

(58) Field of Classification Search
USPC ..... 131/329
See application file for complete search history.

(56) References Cited

U.S. PATENT DOCUMENTS

2011/0155153 A1* 6/2011 Thorens ..... H05B 3/58 131/329
2013/0042865 A1 2/2013 Monsees et al.
2013/0312742 A1 11/2013 Monsees et al.
2014/0283855 A1* 9/2014 Hawes ..... A24F 40/48 131/328
2015/0020832 A1* 1/2015 Greim ..... A24F 40/65 131/329
2015/0208729 A1* 7/2015 Monsees ..... H05B 1/0244 131/329
2016/0021933 A1* 1/2016 Thorens ..... A24F 40/40 131/329
2016/0374400 A1 12/2016 Monsees et al.
2017/0079331 A1 3/2017 Monsees et al.
2017/0231285 A1* 8/2017 Holzherr ..... A24F 40/95 131/329
2019/0208824 A1 7/2019 Wright
2019/0223510 A1 7/2019 Bowen et al.

FOREIGN PATENT DOCUMENTS

RU 2 639 972 C2 12/2017
RU 2 670 534 C1 10/2018
WO WO 2015/177255 A1 11/2015
WO WO 2017/109868 A1 6/2017
WO WO 2018/041450 A1 3/2018
WO WO 2018/055381 A1 3/2018

OTHER PUBLICATIONS

Extended European Search Report issued Nov. 20, 2019 in corresponding European Patent Application No. 19175003.3, 8 pages.
International Preliminary Report on Patentability issued Oct. 12, 2020 in PCT/EP2020/063184 , 14 pages.
Nathan O. Sokal, "Class-E RF Power Amplifiers", published in the bimonthly magazine QEX, edition Jan./Feb. 2001, pp. 9-20, of the American Radio Relay League (ARRL), Newington, CT, U.S.A.
International Search Report and Written Opinion issued on Aug. 12, 2020 in PCT/EP2020/063184 filed on May 12, 2020.
"IQOS 3 Multi Silicone Sleeve Scarlet", Product Code G0000183, 2022 Philip Morris Products, SA, 4 pages.
Japanese Office Action mailed on Jun. 3, 2024, issued in Japanese Patent Application No. 2021-561797, with English Translation, total 8 pages (citing documents 15-16, therein).

* cited by examiner

DEVICE ASSEMBLY METHOD AND DEVICE MANUFACTURED ACCORDING TO SUCH METHOD

This disclosure relates to aerosol-generating devices and a method of manufacturing aerosol-generating devices. In particular, this disclosure relates to aerosol-generating devices that are simple and inexpensive to manufacture and which allow for user customization.

Handheld aerosol-generating devices for heating an aerosol-forming substrate are now widespread and used as an alternative to smoking cigarettes. A handheld aerosol-generating device, such as a personal vaporiser or a "heat-not-burn" device that heats tobacco, typically comprises a plurality of internal components arranged inside a device housing. For example, WO2015/177255 discloses an inductive heating device for heating an aerosol-forming substrate. The device comprises a power source, power supply electronics and a series connection of a capacitor and an inductor all positioned within a device housing. The device housing also defines a cavity having an internal surface shaped to accommodate at least a portion of an aerosol-forming substrate to be heated by the device.

In such handheld aerosol-forming devices, the device housing is a functional component of the device but must also have a pleasing look and feel for users of the device. The housing must secure and protect the internal components from damage and support and accommodate user interface elements, such as buttons, that allow for operation of the device by a user. At the same time, the housing is desirably pleasing to look at and to hold. The look and feel of the device is largely determined by the device housing and is often a significant factor in how users perceive the overall quality of the device. Manufacturing an aerosol-generating device having a device housing that is both functionally and aesthetically acceptable can be complicated and expensive. Furthermore, once the aerosol-generating device has been manufactured, the device housing typically cannot be easily replaced.

It would be desirable to reduce the cost of manufacturing an aerosol-generating device. It would also be desirable to allow user customization of the appearance of an aerosol-generating device and to allow the user to replace the device housing if it becomes scratched or damaged during use of the aerosol-generating device.

In a first aspect, there is provided an aerosol-generating system comprising an aerosol-generating device for heating an aerosol-forming substrate, and an exterior sleeve;

the aerosol-generating device comprising:

a device housing, and a plurality of internal components contained within an interior space enclosed by the device housing;

wherein the device housing comprises an external surface and at least one bent or bendable portion, bent or bendable into or towards the interior space to interact with one of the internal components; and wherein the exterior sleeve is configured to removably cover the at least one bent or bendable portion.

The at least bent or bendable portion may comprise a tab defined by cuts in the external surface. Preferably, the cut extends fully through the device housing. If there is more than one bent or bendable portion there may be more than one tab. The at least one tab may interact with at least one of the internal components in order to retain that internal component. Alternatively, or in addition, the at least one tab may interact with an internal component as part of a user interface of the device, allowing a user to operate the device.

Inexpensive and simple methods of manufacture can be used to manufacture the at least one tab. Advantageously, the exterior sleeve covers the at least one tab so that the at least one tab is not visible to a user of the device. Without the at least one tab being covered, the external surface of the device housing might have an unacceptable appearance or surface finish. By covering the at least one tab with an exterior sleeve an acceptable appearance and feel can be provided.

The exterior sleeve may cover all, or at least the majority of, the device housing. The appearance of an aerosol-generating device covered by an exterior sleeve may depend on the appearance of the exterior sleeve. By providing replaceable exterior sleeves having different appearance, the aerosol-generating device can be customized. The exterior sleeve may comprise visual information, writing or other branding information. For example, the exterior sleeve may be a particular colour or combination of colours. The exterior sleeve may comprise a logo. The exterior sleeve may be opaque. An opaque exterior sleeve advantageously improve the appearance of the device when the device housing has an unacceptable appearance or surface finish.

The exterior sleeve can advantageously be removed from the aerosol-generating device and replaced. The exterior sleeve may be replaced when it has been damaged or scratched. Furthermore, the exterior sleeve may be replaced with a different exterior sleeve having a different appearance, as desired by the user. This advantageously allows the user of the aerosol-generating system to customize their aerosol-generating device after it has been manufactured or purchased. Replacement of the exterior sleeve may be performed by a user of the aerosol-generating system. Alternatively, the user may take the device to an exterior sleeve vendor to perform the replacement of the exterior sleeve.

The device housing may comprise a ductile material. For example, the device housing may comprise a metal or a thermoplastic. The device housing may comprise stainless steel. A ductile material advantageously allows the tabs to be simply formed by bending or pressing.

The aerosol-generating system may comprise a plurality of tabs formed in the external surface of the device housing, wherein at least one tab comprises a fixing element that is deflected into the interior space and engages an internal component. A fixing element formed in this way advantageously provides reliable engagement with the internal component while being inexpensive and simple to manufacture. The fixing element engaging an internal component advantageously holds the internal component in place with respect to the device housing. The engagement may be irreversible.

The fixing element may be formed by deflecting a tab into the interior space of the device housing to engage the internal component. The tab being defined by cuts may advantageously isolate the tab, reducing unwanted deflection of other regions of the external surface when the tab is deflected into the interior space. Cuts defining the tab may advantageously reduce the force required to deflect the tab into a fixing position in which it engages the internal component. The tab for forming a fixing element may be defined by cuts on at least two sides. The tab may be defined by curved cuts in the external surface. Alternatively, or in addition, the tab may be defined by straight cuts in the external surface. The tab may have two uncut ends, or fixed ends, on opposing sides. In such cases the tab for forming a fixing element may preferably be defined by cuts following a convex outer surface of the device housing. This may advantageously allow the tab to be pressed into the interior space without requiring the tab to be stretched.

At least one tab of the external surface of the device housing may comprise a user interface element deflectable by a user toward the interior space of the device housing. A user interface element formed in this way is advantageously inexpensive and simple to manufacture.

The user interface element may be formed by bending a tab. The user interface element may be a lever. The lever may be deflectable by a user toward the interior space of the device housing. The lever may be bent away from the interior space of the device housing to provide a protruding user interface element in a neutral position. Alternatively, the lever may be flush with a surrounding portion of the device housing and deflectable inwards in operation by the user. Alternatively, the lever may be bent towards the interior space of the device housing to provide a sunken user interface element in a neutral position.

The shape and position of the cuts defining the tab for forming the user interface element may be chosen such that the lever has a desired shape and dimensions. The tab may be defined by cuts on at least two sides. The tab may be defined by curved cuts in the external surface. Alternatively, or in addition, the tab may be defined by straight cuts in the external surface. Preferably, the cuts are connected to form a continuous cut defining three sides of a tab.

An interface portion of the exterior sleeve may cover the user interface element when the exterior sleeve covers the device housing. A user of the device pressing on the interface portion may deflect the user interface element towards the interior space of the device housing.

The portion of the exterior sleeve covering the user interface element may comprise markings. These markings may be visible markings. For example, the markings may be printed onto the surface of the exterior sleeve. Alternatively or in addition, the markings may be formed by raised features on the surface of the exterior sleeve. Alternatively or in addition, the marks may be formed by depressions in the exterior sleeve.

The interface portion of the exterior sleeve may comprise a region of increased thickness relative to the rest of the exterior sleeve. This may ensure that there is contact between the exterior sleeve and the lever. This may have the advantage that less force is required by the user when pressing on the interface portion.

Alternatively or in addition, the interface portion of the exterior sleeve may be a region of increased flexibility relative to the rest of the exterior sleeve. The region of increased flexibility may be a result of indents in the exterior sleeve. Advantageously, the indents are configured to allow the portion of the exterior sleeve covering the user interface element to move relative to the rest of the sleeve.

The plurality of internal components may comprise control circuitry configured to sense deflection of the user interface element. Deflection of the user interface element may cause the control circuitry to switch on or activate the aerosol-generating device when deflection of the user interface element is detected. For example, the control circuitry may comprise a switch or a button in contact with the user interface element. Movement of the user interface element by deflection may actuate this switch or button. The control circuitry may further comprise a microprocessor, which may be a programmable microprocessor, a microcontroller, or an application specific integrated chip (ASIC) or other electronic circuitry capable of providing control. The electric circuitry may comprise further electronic components.

The plurality of internal components contained within the device housing may comprise at least one of a power supply, control circuitry, a heater assembly or a receiving portion configured to receive an aerosol-generating article comprising an aerosol-forming substrate.

The power supply may be a battery such as a lithium iron phosphate battery. As an alternative, the power supply may be another form of charge storage device such as a capacitor. The power supply may require recharging and may have a capacity that allows for the storage of enough energy for one or more user operations, for example one or more smoking experiences. The power supply may have sufficient capacity to allow for the continuous generation of aerosol for a period of around six minutes, corresponding to the typical time taken to smoke a conventional cigarette.

The heater assembly may be an inductive heating assembly. An example of an inductive heating assembly is described in WO2015/177255. The inductive heating assembly may comprise an inductor. This inductor may be in the form of a coil or a plurality of coils. The plurality of coils may form a helix. The inductor may be in electrical communication with a power supply. The supply of power from the power supply to the inductor may be controlled by the control circuitry. The control circuitry may use the sensed deflection of a user interface element to begin a heating cycle (i.e. begin supplying power to the inductor). The control circuitry may control the supply of power in accordance with a pre-determined heating profile stored in the control circuitry. The power supply may be a DC power supply and the control circuitry may comprise a DC/AC inverter connected to the DC power source. The DC/AC inverter may comprise a Class-D or Class-E power amplifier. The power supply may comprise power supply electronics configured to operate at high frequency. For the purpose of this application, the term "high frequency" is to be understood to denote a frequency from 1 MHz to 30 MHz, preferably a frequency from 1 MHz to 10 MHz, and even more preferably a frequency from 5 MHz to 7 MHz.

The inductor may be configured to heat a conductive susceptor element in the vicinity of the inductor. The susceptor element may be a conductive element that heats up when subjected to a changing magnetic field. This changing magnetic field may be created in the inductor as a result of high frequency power supply in connection with the inductor. The heating up of the susceptor may be the result of at least one of eddy currents induced in the susceptor element and hysteresis losses. Possible materials for the susceptor elements include graphite, molybdenum, silicon carbide, stainless steels, niobium, aluminium and virtually any other conductive elements. In use, the changing electromagnetic field generated by the inductor heats the susceptor element which then transfers the heat to the aerosol-forming substrate of the aerosol-forming article, mainly by conduction. The susceptor element may be configured to heat the aerosol-forming substrate by at least one of conductive heat transfer, convective heat transfer, radiative heat transfer, and combinations thereof. For this, the susceptor is in thermal proximity to the material of the aerosol forming substrate.

Preferably, the susceptor element does not form part of the aerosol-generating device. Instead, the susceptor is contained within aerosol-generating articles for use with the aerosol-generating device. The susceptor may be in thermal proximity to the aerosol-forming substrate of the aerosol-generating article.

Advantageously, the susceptor element has a relative permeability between 1 and 40000. When a reliance on eddy currents for a majority of the heating is desirable, a lower permeability material may be used, and when hysteresis effects are desired then a higher permeability material may be used. Preferably, the material has a relative permeability between 500 and 40000. This provides for efficient heating.

The material of the susceptor element may be chosen because of its Curie temperature. Above its Curie temperature a material is no longer ferromagnetic and so heating due to hysteresis losses no longer occurs. The Curie temperature may correspond to a maximum temperature the susceptor element should have (that is to say the Curie temperature is identical with the maximum temperature to which the susceptor element should be heated or deviates from this maximum temperature by about 1-3%). This reduces the possibility of rapid overheating.

The plurality of internal components may further comprise a receiving portion configured to receive an aerosol-generating article comprising an aerosol-forming substrate. The heating assembly may be positioned to heat the aerosol-generating article when the aerosol-generating article is received in the receiving portion. The inductor coil of the heating assembly may be positioned in the receiving portion. This has the advantage that the inductor surrounds an aerosol-generating article received in the receiving portion. This is particularly advantageous when the susceptor element is contained within the aerosol-generating article as it ensures a close proximity between the inductor coil of the aerosol-generating device and the susceptor element of the aerosol-generating article.

The device housing may comprise metal. The device housing may be formed from a single piece of material. This simplifies manufacture as there is no need for joints or connections between multiple pieces of housing. Any fixing elements or user interface elements, such as buttons, may be formed in the single piece of material of device housing. This again simplifies manufacture as there is no need for joints or connections between multiple pieces of housing. The device housing may be substantially tubular. The device housing may be substantially cylindrical.

The exterior sleeve may be particularly suitable for devices having a single piece device housing. In particular, the exterior sleeve may be suited to devices that do not comprise any elements that penetrate the aerosol-forming substrate. In devices that include a penetrating element, such as a heater, that penetrates the aerosol-forming substrate, a slidable portion of the device housing is typically provided to aid extraction of the aerosol-forming substrate from the penetrating element after use. Devices that use inductive heating typically do not include any penetrating elements. The exterior sleeve may be particularly suited to devices that use inductive heating.

The internal components may further comprise a flux concentrator. The flux concentrator may distort fluctuating magnetic field generated by the inductor coil towards the centre of the receiving portion (i.e. towards the aerosol-forming article received in the receiving portion). This advantageously concentrates the magnetic field within the receiving portion and so increases the level of heat generation in the susceptor for a given level of power passing through the inductor coil. The flux concentrator may also comprise an electromagnetic shield which may be positioned to prevent magnetic field from escaping an inductor. If the inductor is in the shape of a coil, the flux concentrator may have an annular shape. The flux concentrator may then be positioned to surround the inductor coil.

The exterior sleeve may comprise silicone. Silicone is advantageously both durable and flexible. Silicone also has elastic properties. An exterior sleeve comprising silicone may advantageously be inexpensive to manufacture while being easy to mould into a desired shape having a desired appearance. Features may be moulded into an exterior sleeve comprising silicone.

The exterior sleeve may comprise a plurality of separate parts connected together. An exterior sleeve comprising a plurality of parts may advantageously be easier to fit to, or remove from, the aerosol-generating device. If the exterior sleeve has a portion covering the user interface element this may be formed in only one of the plurality of separate parts. The parts may have a very similar appearance (i.e. for example, each part may comprise the same visual information, writing or branding). Alternatively, one part may have a different to appearance to another. The plurality of parts of the exterior sleeve may be connected by a snap-fit connection.

As used herein, the term "snap-fit connection" means a connection comprising one male part and one female part. The male part may be formed in a first part of the exterior sleeve and the female part formed in a second part of the exterior sleeve. In a stress-free state, the male and female part may not fit together. However, the exterior sleeve may have elastic properties and so when a force is applied one, or both of the male and female parts may bend, allowing the first and second parts to be fitted together. After the joining operation, the male and female parts may return to a stress-free state. Snap-fit connections advantageously allow for removable, yet resilient, connection between the first and second parts of the exterior sleeve. The female part may be a groove formed in the first part of the exterior sleeve. The male part may be a lip or rib formed in the second part of the exterior sleeve.

As used herein, the term "aerosol-generating substrate" relates to a substrate capable of releasing volatile compounds that can form an aerosol. Such volatile compounds may be released by heating the aerosol-forming substrate. An aerosol-forming substrate may conveniently be part of an aerosol-forming article.

As used herein, the term "aerosol-generating article" refers to an article comprising an aerosol-forming substrate that is capable of releasing volatile compounds that can form an aerosol. For, example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol. The aerosol-generating device may be reusable.

As used herein, the term "exterior sleeve" refers to a sleeve that is configured to fit over an aerosol-generating device.

As used herein, the term "aerosol-generating system" refers to the combination of an aerosol-generating article, an aerosol-generating device and an exterior sleeve.

Preferably, the aerosol-forming substrate comprises a tobacco-containing material including volatile tobacco flavour compounds which are released from the aerosol-forming substrate upon heating. Alternatively, the aerosol-forming substrate may comprise a non-tobacco material. The aerosol-forming substrate may comprise an aerosol former that facilitates the formation of a dense and stable aerosol. As used here, the term "aerosol former" is used to describe any suitable known compound or mixture of compounds that, in use, facilitates formation of an aerosol. Suitable aerosol formers are substantially resistant to thermal degradation at the operating temperature of the aerosol-generating article. Examples of suitable aerosol formers are glycerine and propylene glycol.

The aerosol-forming substrate may be a solid aerosol-forming substrate. Alternatively, the aerosol-forming substrate may comprise both solid and liquid components. In a particularly preferred embodiment, the aerosol-forming substrate comprises a gathered crimped sheet of homogenised tobacco material. As used here, the term "crimped sheet" denotes a sheet having a plurality of substantially parallel ridges or corrugations.

In a second aspect of the invention, there is provided a kit comprising an aerosol-generating device for heating an aerosol-forming substrate and at least one exterior sleeve:

the aerosol-generating device comprising:

a device housing, and a plurality of internal components contained within an interior space enclosed by the device housing;

wherein the device housing is formed from a single piece of material and comprises an external surface and at least bent or bendable portion, bent or bendable into or towards the interior space to interact with one of the internal components; and wherein the at least one exterior sleeve is configured to removably cover the at least one bent or bendable portion.

The at least one bent or bendable portion may comprise a tab defined by cuts in the external surface.

The kit may comprise a first exterior sleeve and a second exterior sleeve, wherein the first exterior sleeve comprises an external surface comprising visual information, writing or other branding information and the second exterior sleeve comprises an external surface comprising visual information, writing or other branding information different to the visual information, writing or other branding information of the external surface of the first exterior sleeve. This advantageously allows the user to customize the aerosol-generating device. For example, the user may have a preference as to the appearance of the first or second exterior sleeve and can fit whichever they prefer to the aerosol-generating device. This may be done at home or with the help of an expert who performs the fitting on the behalf of the user.

In a third aspect of the invention, there is provided method of manufacturing an aerosol-generating system comprising the steps of:

providing a device housing for containing a plurality of internal components within an interior space and wherein the device housing comprises an external surface;

providing at least one bent or bendable portion in the device housing that is bent or is bendable towards the interior space to interact with one of the internal components; and providing an exterior sleeve configured to removably cover the at least one bent or bendable portion.

The method of manufacturing an aerosol-generating system may further comprise the step of deflecting the at least one bent or bendable portion into the interior space to interact with one of the components and fitting the exterior sleeve onto the device housing.

The method of manufacturing an aerosol-generating system may further comprise the step of cutting the external surface of the device housing to define at least one tab as the at least one bent or bendable portion, wherein the tab is deflectable towards the interior space to interact with one of the internal components. Features described in relation to one aspect may be applied to other aspects of the disclosure. In particular, advantageous or optional features described in relation to the first aspect of the disclosure may be applied to the second and third aspects of the invention.

Embodiments of an aerosol-generating system and method of manufacturing the aerosol-generating system will now be described in detail, by way of example only and with reference to the accompanying drawings, in which.

Figure 1:
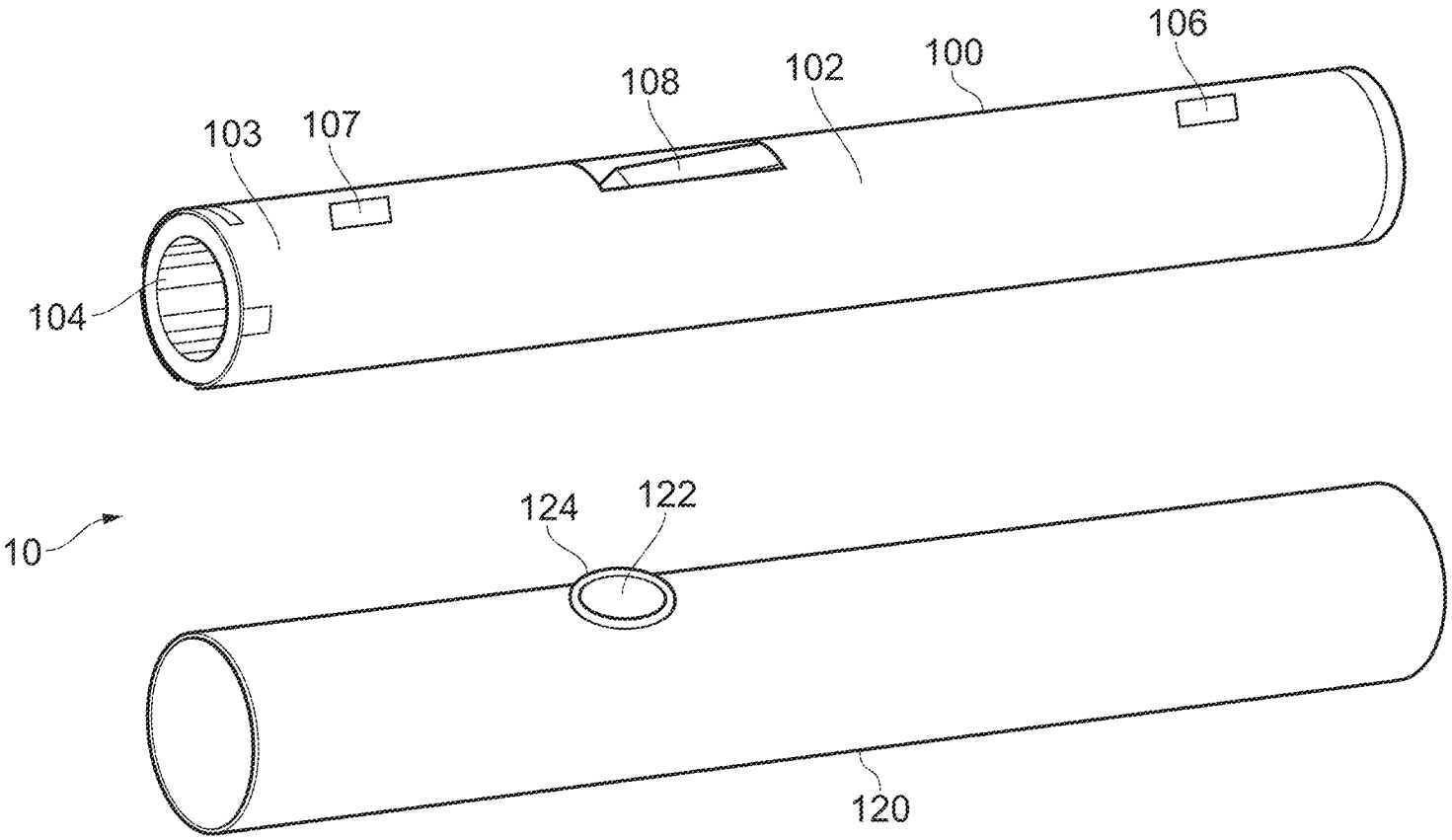
FIG. 1 is a perspective view of an aerosol-generating system comprising an aerosol-generating device and an exterior sleeve.

FIG. 1 shows a perspective view of an aerosol-generating system 10 comprising an aerosol-generating device 100 and an exterior sleeve 120. The aerosol-generating device 100 is configured for heating an aerosol-forming article comprising an aerosol-forming substrate. The aerosol-generating device 100 comprises a device housing 102 and a plurality of internal components, not visible in FIG. 1. The device housing 102 has an external surface 103 and encloses an interior space 104. The plurality of internal components are contained within internal space 104. The device housing 102 is tubular and is formed from a single piece of metal. A plurality of bendable portions are formed in the external surface 103 of the device housing 102 which are bent or bendable into or towards the interior space 104 to interact with one of the internal components. Each bendable portion comprises a tab 106, 107 and 108 defined by cuts in the external surface 103 of the device housing 102. Each tab 106, 107 and 108 interacts with one of the internal components.

Tabs 106 and 107 are fixing elements. Each fixing element is formed by cutting through the external surface 103 to define a tab and then deflecting that tab toward the interior space 104. The fixing elements 106, 107 interact with internal components by engaging the internal components. This engagement holds the respective internal components in place with respect to the device housing 102.

Tab 108 is a user interface element in the form of a lever. The lever 108 is formed by cutting into the device housing 102 to form a tab and bending that tab towards the interior space of the device housing such that it enters the interior space of the device housing. The lever 108 is deflectable further into the interior space of the device housing when operated by a user. The lever interacts with an internal component when it is deflected.

Device housing 102 securely houses the internal components, protecting them from damage as well as supporting any further user interface elements, such as LEDs. Forming the tabs in the external surface 103 by cutting and then deflecting or bending the tabs is inexpensive and simple. Device housing 102 is functionally operable without the requirement for any exterior sleeve. However, the device housing 102 having cut out tabs is not pleasing to look at or to hold.

By providing an exterior sleeve 120 on the aerosol-generating device 100, the aerosol-generating device can be made aesthetically acceptable. In the embodiment shown in FIG. 1, the exterior sleeve 120 is configured to removably cover the entire external surface 103 of the device housing. However, this may not be required. The aerosol-generating device 100 may be aesthetically acceptable if the exterior sleeve 120 covers enough of the external surface 103 that any tabs are covered. Some portions of device housing 102 may have an acceptable look and feel.

The exterior sleeve 120 is made of silicone, which is both durable and flexible, and is moulded to match the shape of the aerosol-generating device 100 such that when the exterior sleeve is fitted there is a close fit between sleeve and device, and the exterior sleeve does not easily move relative to the device housing. The exterior sleeve is held in place by friction between the exterior sleeve and the device housing.

The exterior sleeve 120 comprises interface portion 122. When the exterior sleeve 120 covers the aerosol-generating device 100, the interface portion 122 covers lever 108. A user of the device pressing on the interface portion 122 deflects the lever 108 towards the interior space 104 of the device housing 102. The interface portion 122 is defined by a raised ring 124 formed in the surface of the exterior sleeve 120. The raised ring 124 is an indicator to a user of the device as to the location of the lever 108, covered by the exterior sleeve 120.

As described above, using the exterior sleeve 120 to cover the aerosol-generating device 100 results in the aerosol-generating device 100 having an acceptable look and feel. The appearance of the aerosol-generating device 100 depends on the appearance of the exterior sleeve 120. Customized exterior sleeves 120 with a particular appearance may be provided. By removing and replacing a first exterior sleeve with a second exterior sleeve the appearance of the aerosol-generating device 100 can be changed, thus allowing for continued customization of the aerosol-generating device. This is exemplified in FIG. 2.

Figure 2:
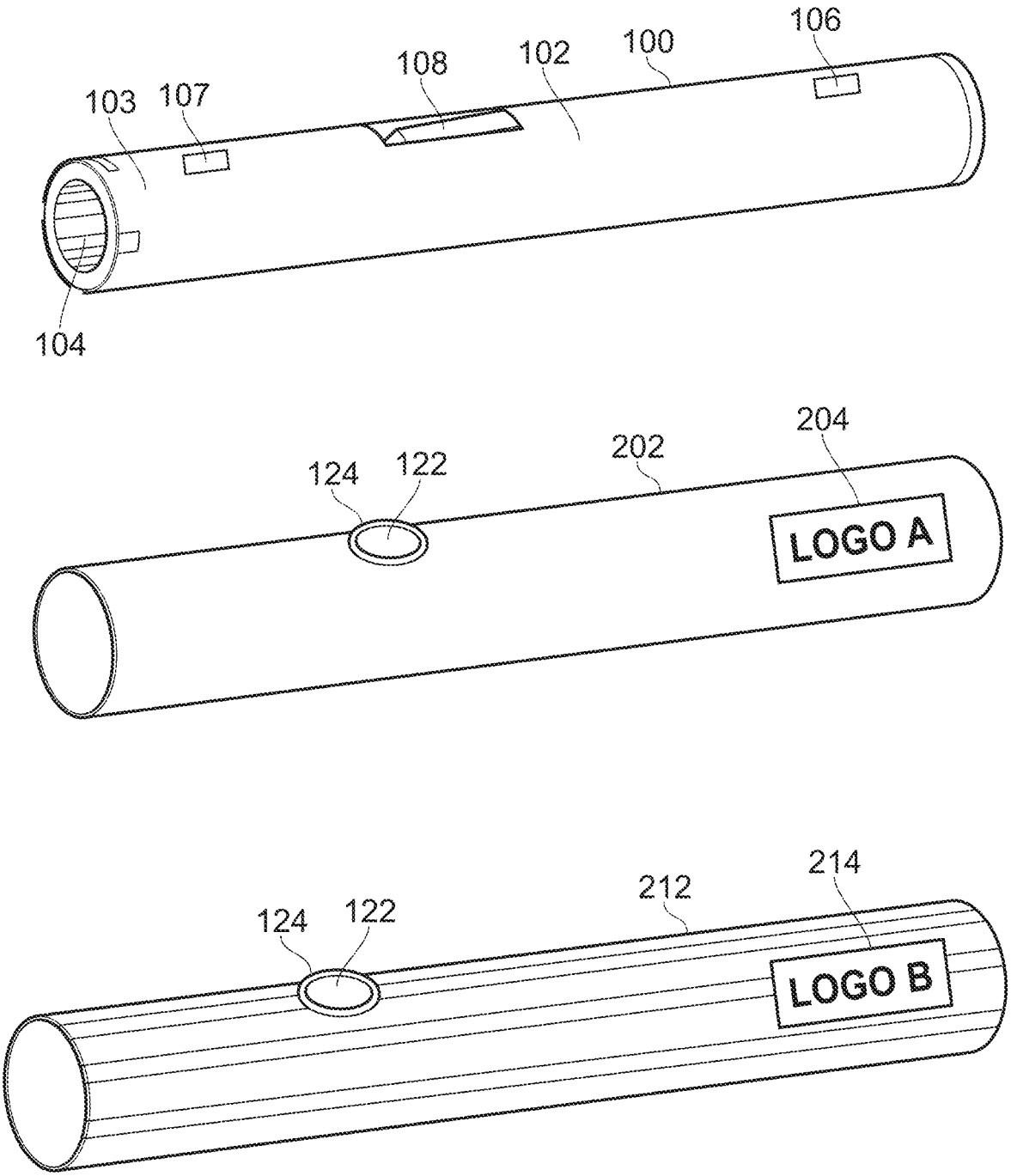
FIG. 2 is a perspective view of a kit comprising the aerosol-generating device of FIG. 1 and first and second exterior sleeves, the first sleeve comprising different visual information, writing or branding to the second sleeve.

FIG. 2 is a perspective view of a kit comprising an aerosol-generating device 100, as described in relation to FIG. 1, and first and second exterior sleeves 202, 212. The first and second exterior sleeves 202, 212 are identical to one another, and to exterior sleeve 120 described above, apart from having a different appearance. Exterior sleeve 202 comprises a first logo 204 and is a single colour. Exterior sleeve 212 comprises a second logo 214 and has a striped pattern consisting of two, different, alternating colours. Therefore, exterior sleeve 202 has a different appearance to exterior sleeve 212. Covering the aerosol-generating device 100 with exterior sleeve 212 instead of exterior sleeve 202 (or vice versa) will alter the appearance of the aerosol-generating device 100. This allows for customization of the aerosol-generating device 100.

It should be understood that the exterior sleeves 202 and 212 shown in FIG. 2 are exemplary. Exterior sleeves may comprise any visual information, writing or other branding so as to give the aerosol-generating device a desired appearance. Furthermore, it should be clear that the first and second logo 204 and 214 are merely placeholders demonstrating that different sleeves may comprise different branding and do not represent actual branding to be included on exterior sleeves.

Figure 3:
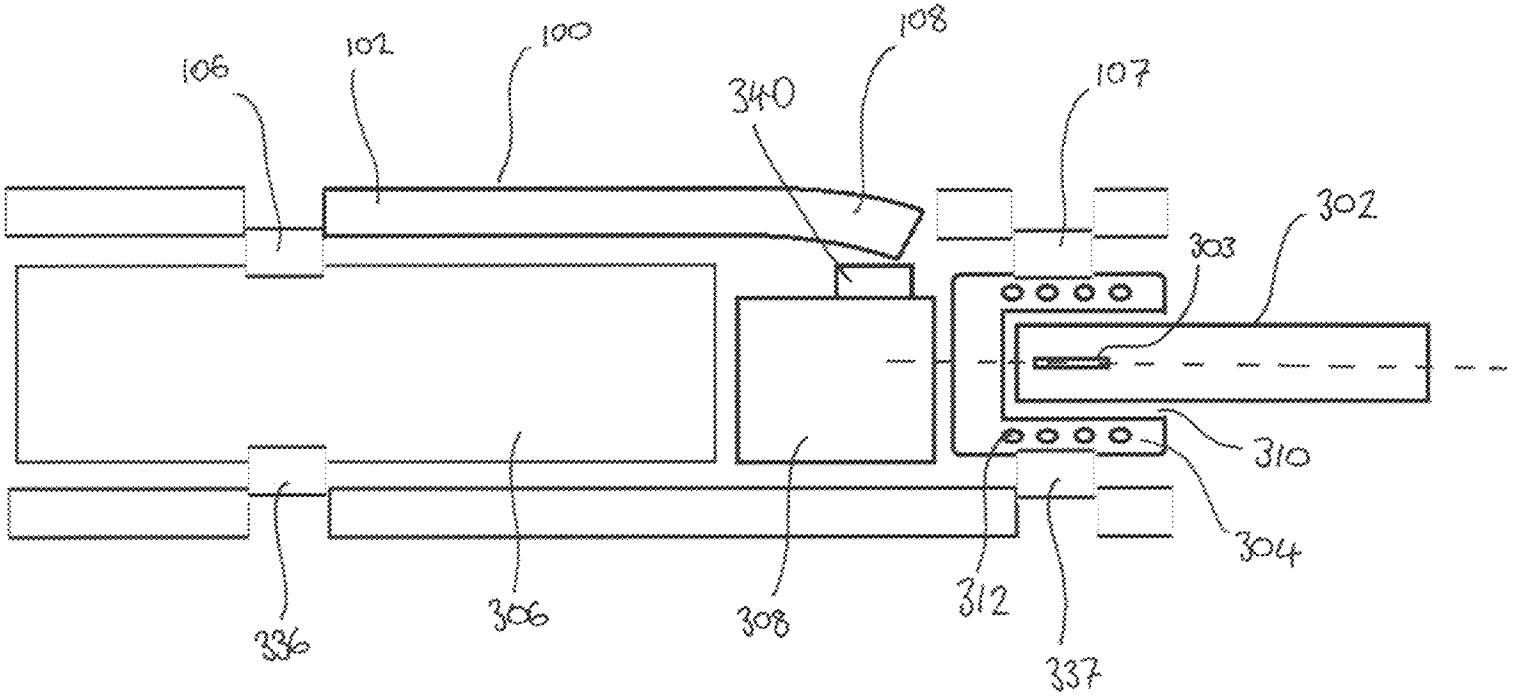
FIG. 3 is a cross-sectional schematic of the aerosol-generating device of FIG. 1 in which an aerosol-generating article is received.

FIG. 3 is a cross-sectional schematic of the aerosol-generating device 100, in which an aerosol-generating article 302 is received. FIG. 3 shows a plurality of internal components contained within device housing 102.

The aerosol-generating device 100 comprises a receiving portion 304. The receiving portion 304 comprises an opening 310 through which the aerosol-generating article 302 may be inserted and removed. The receiving portion also comprises a heating assembly comprising inductor coil 312. The inductor coil 312 is a helical inductor coil having a magnetic axis corresponding to the longitudinal axis of the receiving portion 304, see dotted line of FIG. 3. The aerosol-generating device 100 also comprises power supply 306, for example a rechargeable battery, and control circuitry 308, for example a printed circuit board with circuitry. The control circuitry 308 and the inductor coil 312 both receive power from the power supply 306.

The aerosol-forming article 302 comprises aerosol-generating substrate and a conductive susceptor element 303 arranged within the aerosol-generating article 302 such that it is inductively heatable by the inductor coil 312 when the aerosol-forming article 302 is received in the receiving portion 304. The aerosol-forming substrate is a tobacco-containing material including volatile tobacco flavour compounds which are released from the aerosol-forming substrate upon heating. The aerosol-forming substrate also comprises an aerosol former such as glycerine or propylene glycol that facilitates the formation of a dense and stable aerosol.

The operation of the aerosol-generating device 100 is controlled by control circuitry 308. This includes initiating a heating cycle whereby the control circuitry 308 controls the supply of power to the inductor coil 312 in accordance with a pre-determined heating profile stored in the control circuitry 308.

The control circuitry 308 comprises a DC/AC inverter connected to the power source 306, which is a DC power source. The DC/AC inverter includes a Class-E power amplifier including a transistor switch, a transistor switch driver circuit, and an LC load network. Class-E power amplifiers are generally known and are described in detail, for example, in the article "Class-E RF Power Amplifiers", Nathan O. Sokal, published in the bimonthly magazine QEX, edition January/February 2001, pages 9-20, of the American Radio Relay League (ARRL), Newington, CT, U.S.A. Therefore, a high frequency current can be supplied to the inductor coil 312. A changing magnetic field is created by the inductor as a result the high frequency current. This induces changing currents in the conductive susceptor element 303, resulting in the heating up of the susceptor element 303. The heated susceptor element 303 heats the aerosol-forming substrate of the aerosol-generating article 302 to a sufficient temperature to form an aerosol. The aerosol can then be drawn downstream through the aerosol-generating article 302 for inhalation by the user of the device.

The receiving portion 304 further comprise a flux concentrator comprising an electromagnetic shield (not shown in FIG. 3) which surrounds the inductor coil 312. The flux concentrator distorts the fluctuating magnetic field generated by the inductor coil 312 towards the centre of the receiving portion 304 (i.e. towards the aerosol-forming article 302 received in the receiving portion 304). This concentrates the magnetic field within the receiving portion 304 and so increases the level of heat generating in the susceptor element 303 for a given level of power passing through the inductor coil 312. The flux concentrator is tubular and surrounds the inductor coil, extending along its longitudinal axis. The flux concentrator is made from ferrite. The electromagnetic shield reduces undesired heating of adjacent conductive parts of the device, for example the metallic device housing, or of adjacent conductive items external to the aerosol-generating device 100. Focusing the magnetic field of the inductor coil 312 and reducing undesired heating and losses increases the efficiency of the aerosol-generating device 100.

Figure 4:
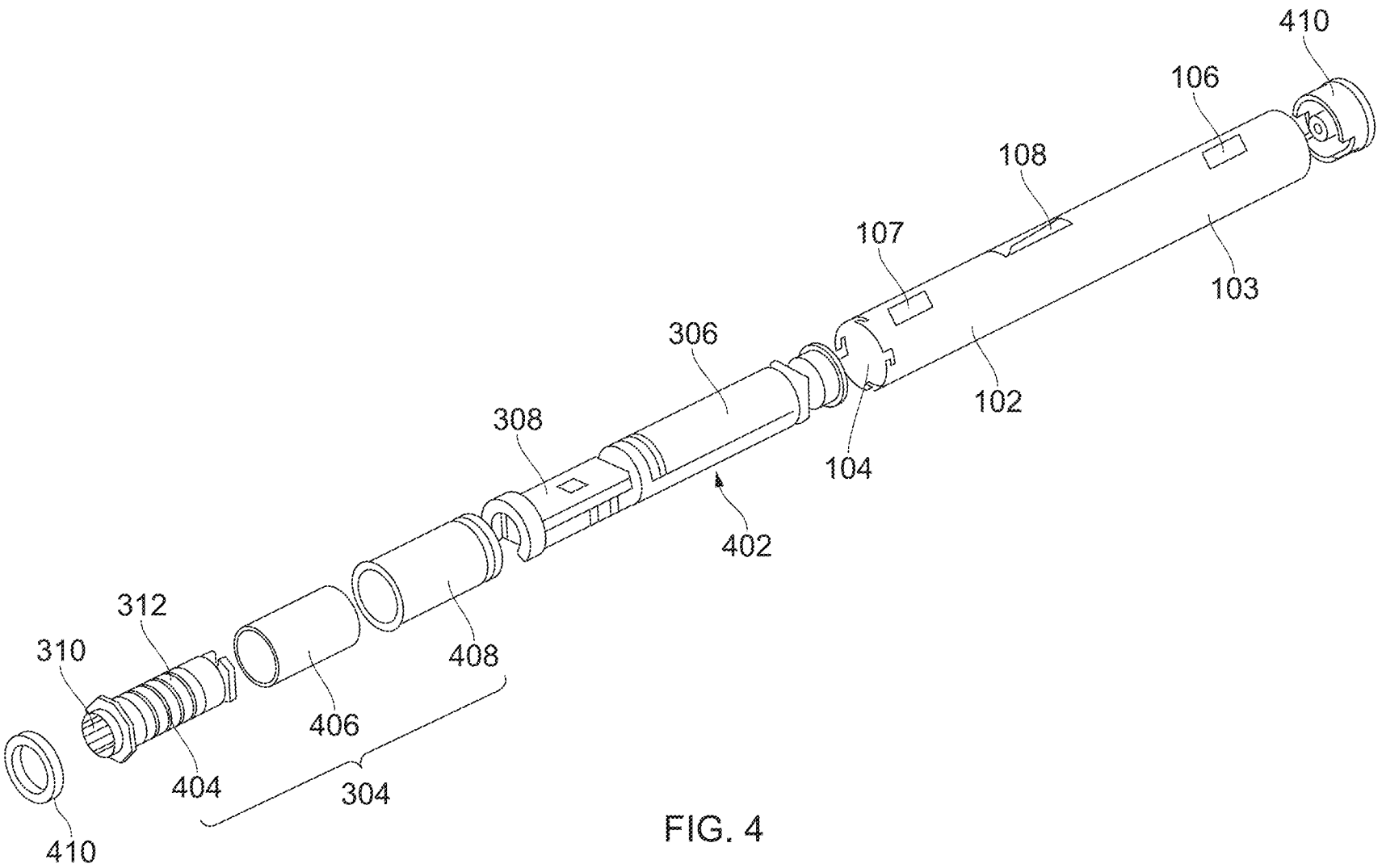
FIG. 4 is an exploded perspective view of the aerosol-generating device of FIG. 1, showing the internal components that are contained by the device housing.

FIG. 4 is an exploded perspective view of the aerosol-generating device 100, showing the plurality internal components and the device housing 102 with external surface 103. A main frame 402 hosts the power supply 306 and control circuitry 308. The receiving portion 304 is an assembly of a coil former 404, a flux concentrator 406 (as described above) and an encapsulation sleeve 408 with each fitting sequentially into the other. The encapsulation sleeve is a protective outer layer for holding the flux concentrator in place. The coil former 404 comprises the inductor coil 312. Coil former 404 defines an opening 310 in which the aerosol-generating article 302 is received. When the aerosol-generating device 100 is assembled, the main frame 402 is inserted into the interior space 104 of device housing 102, followed by the assembled receiving portion 304 which abuts the main frame 402. End pieces 410 are pushed into the device housing 102 at either end.

The lever 108, formed in the device housing 102, is in contact with the control circuitry 308 when the main frame 402 is inserted into the device housing 102. Deflection of lever 108 is detected by the control circuitry 308. The control circuitry then initiates the heating cycle described previously.

Fixing means 106 is in contact with the power supply 306 and fixing means 107 is in contact with the receiving portion 304. This prevents movement of the internal components with respect to the device housing.

Figure 5:
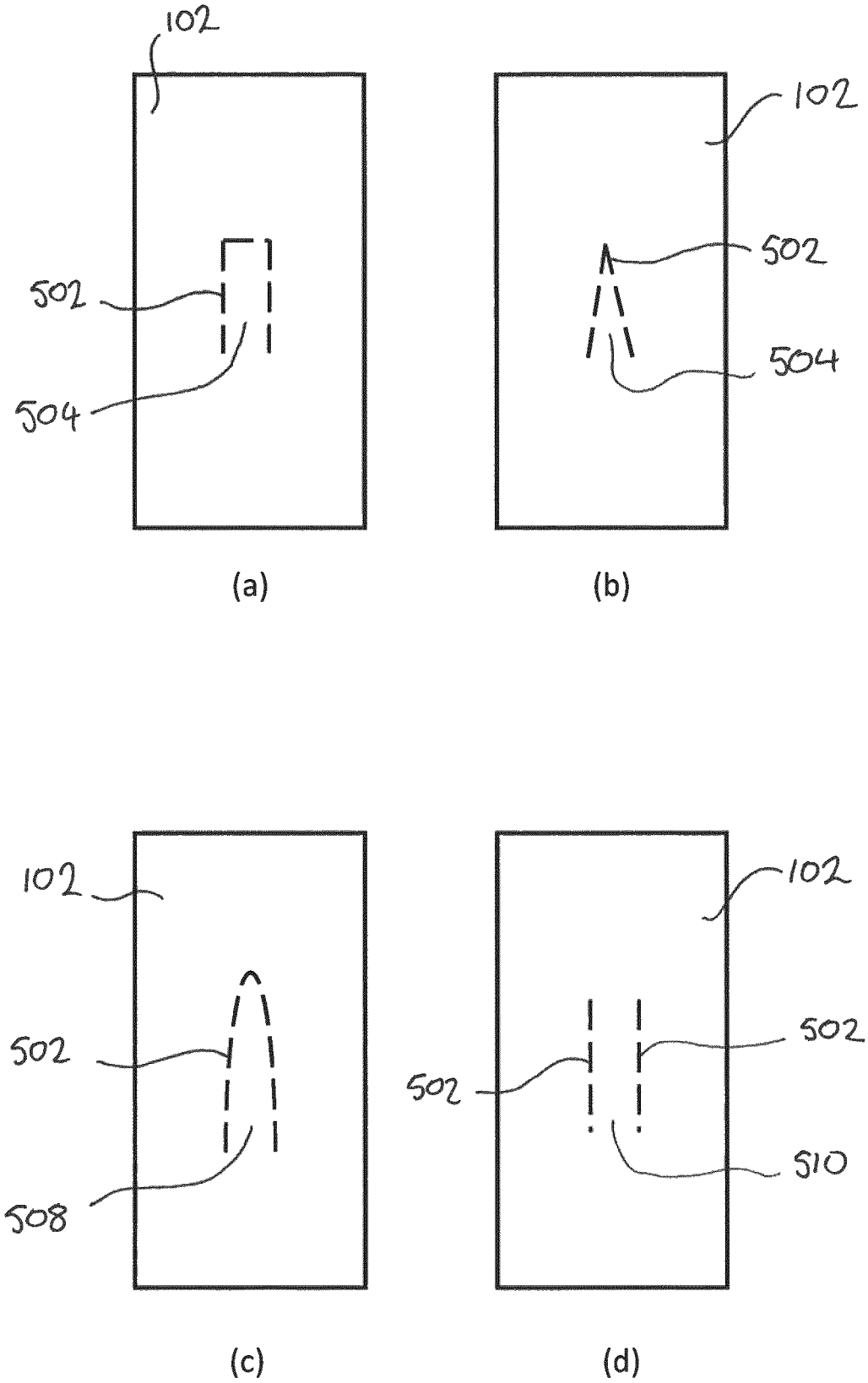
FIG. 5 shows four embodiments of cuts in the device housing of the aerosol-generating device of FIG. 1, where each embodiment is shown as a plan schematic of the device housing from above.

FIG. 5 is a plan schematic of a portion of the device housing 102, showing embodiments of cuts in the device housing 102 defining regions which can form tabs. Cuts are shown by dotted lines 502. The region defined by the cuts 502 in each embodiment has a different shape. It would be well understood by the skilled person that the tabs formed by from these regions will have different shapes.

FIG. 5(*a*) shows an embodiment where cuts 502 define a region 504 in the device housing on three sides. The fourth side of region 504 is not cut. One end of region 504 is surrounded by cuts, and will be referred to herein as the free end. The other end is not cut, and will be referred to herein as the fixed end.

A fixing element is formed when region 504 is deflected towards the interior space of the device housing such that the free end will be lower than the fixed end and the free end interacts with internal component to hold it in place.

A user interface element is formed because region 504 is deflectable into the interior space 104 of the device housing 102. In some embodiments, the user interface element is bent into or away from the interior space of the device housing in a neutral position. However, this is not required. The user interface element is a lever and so the closer to the free end that the user presses, the lower the force that is required to deflect the lever.

FIGS. 5(*b*) and 5(*c*) show similar embodiments where region 506 and 508 has a free end, defined by cuts on all sides, and a fixed end. The cuts in the different embodiments have different shapes and so the region defined by the cuts has a different shape.

The embodiment shown in FIG. 5(*d*) differs from the embodiments of FIGS. 5(*a*) to (*c*) in that it is formed from two parallel cuts, adjacent to one another and of substantially equal length. The region 510 defined between these two cuts does not have a free end, rather it has two fixed ends.

The tab of FIG. 5(*d*) has an axis defined from a first fixed end to a second fixed end. The tab axis preferably follows a convex outer surface of the device housing. This allows the tab to be pressed into the interior space without requiring the tab to be stretched.

A fixing element is formed when region 510 is deflected towards the interior space 104 of the device housing 102. The central portion of the region 510 interacts with the internal component.

Referring back to FIG. 3, the aerosol-generating device comprises a plurality of fixing elements 106, 107, 336, 337 formed from cuts in the device housing and interacting with internal components. The aerosol-generating device also comprises lever 108 interacting with the control circuitry 308.

The fixing elements 106, 107, 336, 337 are formed from cuts in the device housing 102 as shown in FIG. 5(*d*). Fixing elements 106 and 336 are deflected to interact with the power supply 306. Fixing elements 107 and 337 are deflected to interact with the receiving portion 304. The interaction with the power supply 306 and receiving portion 304 is that the fixing elements are deflected to be in frictional contact and so hold the power supply and receiving portion in place with respect to the device housing. In the embodiment shown in FIG. 3 the fixing elements are deflected into grooves in the respective components. This improves the reliability of the fixing elements to hold the components in place but is not a required feature. Frictional contact between fixing element and internal component is enough. Furthermore, in the embodiment shown in FIG. 3, the power source 306 and receiving portion 304 are each held in place by two fixing means on opposite sides of each component. Again, this is not a required feature. There may be any number of fixing means in contact with any number of internal components, depending on the particular design of the aerosol-generating device.

Lever 108 is formed from cuts in the device housing 102 according to the embodiment shown in FIG. 5(*a*). Lever 108 has been bent towards the interior space of the device housing 102 such that it is in close proximity to switch 340, which forms part of control circuitry 308. Lever 108 is deflectable. Deflection of lever 108 can be sensed by switch 340. When deflection is sensed the control circuitry 308 is configured to initiate operation of the aerosol-generating device. For example, by initiating a heating cycle whereby the control circuitry 308 controls the supply of power to the inductor 312 in accordance with a pre-determined heating profile stored in the control circuitry 308.

The embodiment shown in FIG. 3 comprises both fixing elements and user interface elements. However, an aerosol-generating device may comprise only fixing elements or user interface elements. For example, the aerosol-generating device may comprise a puff sensor in the form of a microphone. In such an embodiment a user interface element may not be required as the operation of the device may be initiated when the microphone detects air-flow through the device as a result of a user puffing on an aerosol-generating article 302 received in the aerosol-generating device 100. In such an embodiment there may be at least one fixing element and no user interface element. In another embodiment the plurality of internal components need only be held in place at either end of the device housing 102 by end pieces 410 inserted into the aerosol-generating device 100. Therefore, there may be no need for fixing elements formed by tabs.

Figure 6:
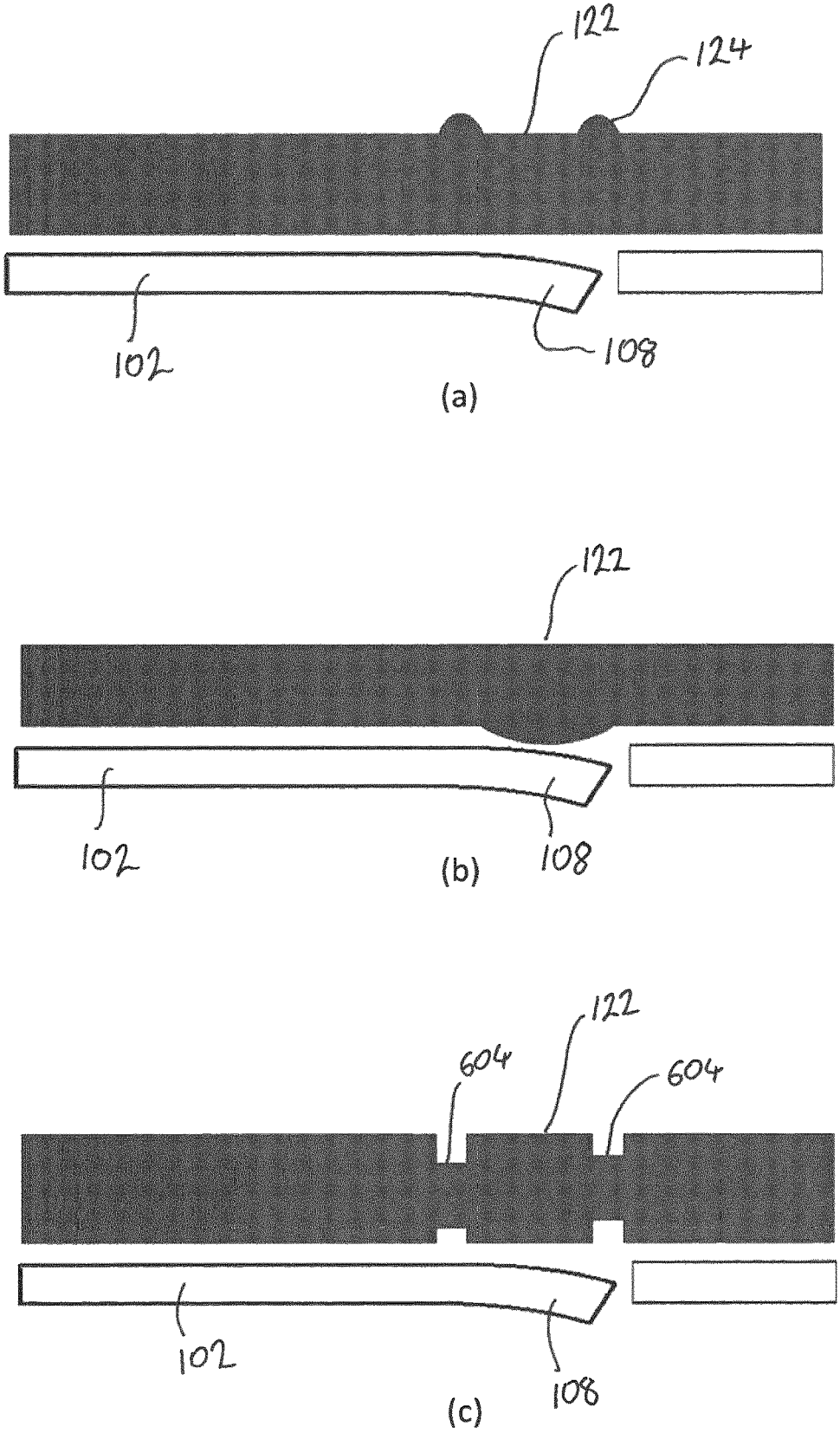
FIG. 6 is a cross-sectional schematic showing three different embodiments of the external sleeve of FIG. 1 covering the aerosol-generating device of FIG. 1. Each embodiments is shown as a close-up cross-sectional schematic.

The contact between the exterior sleeve 120 and the lever 108, and particularly the interface portion 122 and the lever 108, is show in FIG. 6. FIG. 6 shows three different embodiments of a portion of the exterior sleeve 120 covering lever 108 as close-up cross-sections.

FIG. 6(*a*) shows a first embodiment of interface portion 122. In this embodiment the interface portion 122 is defined by markings in the form of a raised feature in the surface of the exterior sleeve. The raised feature is a raised ring 124 in the surface of the exterior sleeve 120. The raised ring 124 acts as an indicator to a user of the device as to the location of the lever 108. When the user pushes down on the interface portion 122, the exterior sleeve, which is made of flexible silicone, will bend toward the lever 108. Once in contact with the lever 108 the lever 108 will be deflected towards the interior space 104 of the of aerosol-generating device 100.

FIG. 6(*b*) shows a second embodiment of interface portion 122. In this embodiment the interface portion of the exterior sleeve 120 comprises a region of increased thickness 602 relative to the rest of the exterior sleeve 120. As shown in FIG. 6(*b*), the increased thickness 602 is on the side of the exterior sleeve 120 in contact with lever 108. This reduces the distance that the interface portion 122 is required to move before deflecting the lever 108 and so less force is required by the user when pressing on the interface portion 122 to deflect the lever 108.

FIG. 6(*c*) shows a third embodiment of interface portion 122. In this embodiment the interface portion 122 is defined by an indent 604 in the exterior sleeve. The indent 604 has a ring shape. The indent 604 is a region of reduced thickness relative to the rest of the exterior sleeve 120, and so has increased flexibility relative to the rest of the exterior sleeve 120. This reduces the amount of force required to bend the exterior sleeve 120 such that interface portion 122 deflects lever 108. In the embodiment shown in FIG. 6(*c*) the indent 604 is on both sides of the exterior sleeve. However, it should be understood that the indent 604 may be on only one side.

The features of FIG. 6(*a*) to (*c*) can be combined. For example, the embodiment shown in FIG. 6(*b*) may also comprise the raised ring 124 shown in FIG. 6(*a*) or the indent 604 shown in FIG. 6(*c*).

Figure 7:
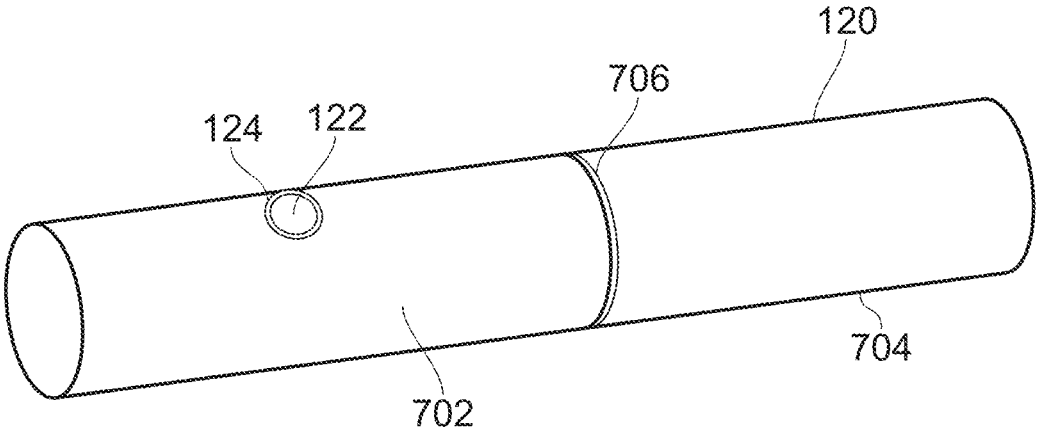
FIG. 7 is a perspective view of an embodiment of the exterior sleeve of FIG. 1 comprising two connected parts.
Figure 8:
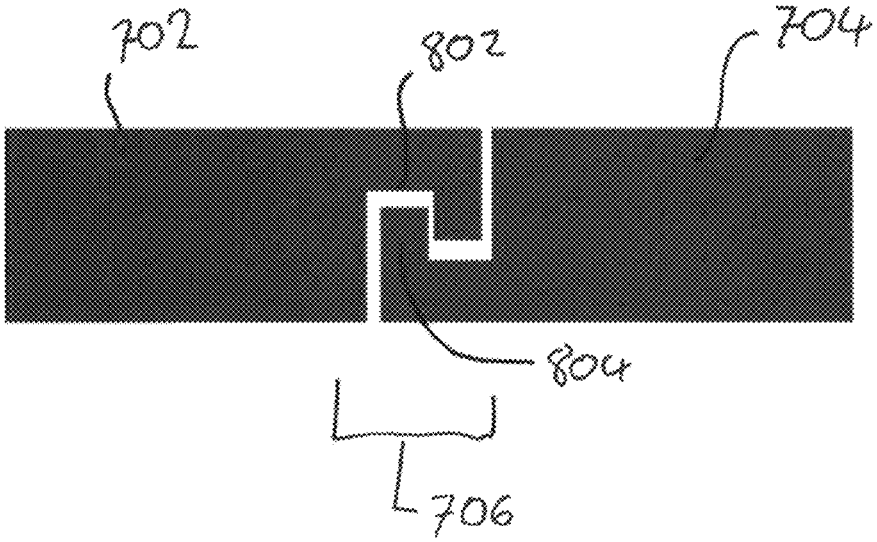
FIG. 8 is a close-up schematic view of the connection between two connected parts of exterior sleeve of the exterior sleeve shown in FIG. 8.

FIG. 7 is a perspective view of an embodiment of exterior sleeve 120 comprising a first part 702 and a second part 704 connected together at connection 706. The interface portion 122 forms part of the first part 702. The connection 706 is shown as a close up cross-section in FIG. 8. Connection 706 is a snap-fit connection. The first part 702 is a female part, comprising groove 802. The second part 704 is a male part, comprising lip or rib 804. In a stress-free state, the lip 804 and groove 802 do not fit together. However, the exterior sleeve 120 has elastic properties and so the when a force is applied, one or both of the lip 804 and groove 802 is bent, allowing the first and second parts to be fitted together. After the joining operation, the lip 804 and groove 802 return to a stress-free state, forming a removable, yet resilient, connection.

Figure 9:
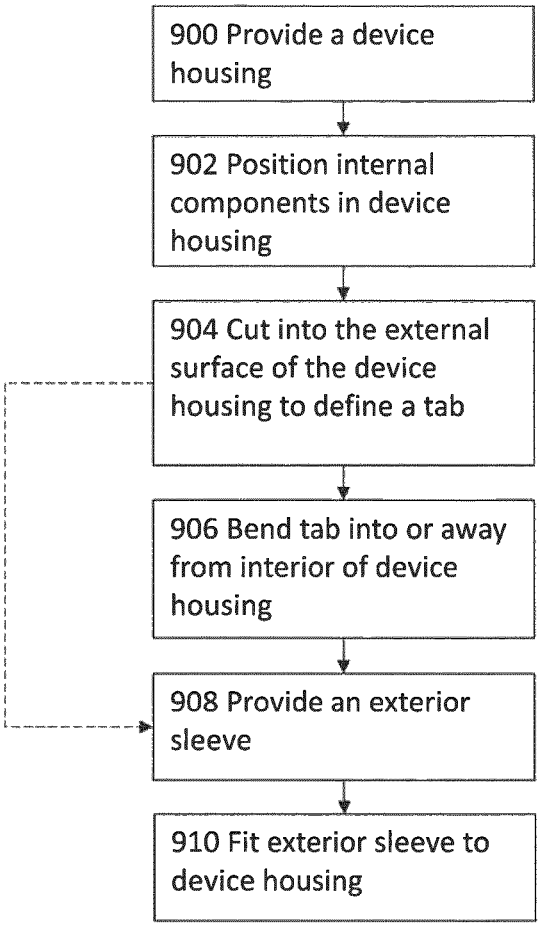
FIG. 9 is a flow diagram representing a method of manufacturing the aerosol-generating system shown in FIG. 1.

FIG. 9 is a flow diagram representing a method of manufacturing the aerosol-generating system shown in FIG. 1.

First, in step 900 a device housing 102 is provided. As previously described, the device housing 102 is tubular and encloses an interior space. The device housing 102 is made of metal.

In step 902 a plurality of internal components are positioned in the internal space 104 of the device housing 102. Prior to this step the internal components need to be assembled. The power supply 306 and control circuitry 308 are both hosted on main frame 402. The receiving portion 312 is assembled from a coil former 404, inserted into a flux concentrator 406 which is then inserted into an encapsulation tube 408. The assembled receiving portion 312 abuts the main frame 402 and is mechanically engaged to the main frame 402. This mechanical engagement comprises electrical connections such that the power supply 306 and control circuitry 308 of the main frame 402 are in electrical communication with receiving portion 412.

In step 904 cuts are made in the external surface 103 of the device housing by pressing a cutting tool into the external surface 103 with enough force to cut through the external surface 103 of the device housing 102. The cuts in the device housing define a tab which is a bent or bendable portion of the exterior housing. Any number of tabs may be defined by cutting into the external surface 103. The tabs may be defined simultaneously or sequentially, depending on the cutting tool used.

In some embodiments of the manufacturing method the plurality of internal components may be positioned in the internal space of the device housing 102 after the cuts are made in the external surface 103 of the device housing 102. In such embodiments step 902 will occur after step 904.

In step 906 a tab is bent or deflected into or away from the interior of the device housing using a pressing tool. If more than one tab is defined in step 904, then any number of these tabs may be bent or deflected. A fixing element is formed when a tab is deflected towards the interior space of the device housing using a press, until it engages an internal component positioned within the device housing 102. A user interface element is formed when a tab is bent toward the internal space 104 of the device housing using a press die tool until it is in close proximity with an internal component positioned within the device housing will form a user interface element. Lever 108 is an example of such user interface element formed in this way. Alternatively or additionally, a user interface element can be formed by bending a tab away from the interior of the device housing.

Step 906 of the manufacturing process is optional. Bending or deflecting the tabs defined in step 904 is not required for some user interface elements. A user interface element may be a tab that is deflectable towards the interior space. The tab is deflectable once it has been cut. It is not a requirement that a tab is bent in order for it to form a user interface element. For such a user interface element, step 906 is not performed and the manufacturing process jumps straight from step 904 to 908. This is shown by the dotted arrow of FIG. 9.

In step 908 an exterior sleeve 120 is provided. The exterior sleeve 120 is moulded from silicone. In embodiments where the aerosol-generating device 100 comprises a user interface element, the moulded exterior sleeve comprises an interface region 122. This interface region 122 is moulded into the exterior sleeve. The exterior sleeve 120 is fitted to the device housing to cover the tabs cut into the device housing 100. In some embodiments, either or both of steps 908 and 910 form part of a process that is separate to the process outlined in steps 900 to 906. For example, the fitting of the exterior sleeve 120 to the device housing may be performed by a user of the device after purchasing the device and the exterior sleeve 120 separately. The fitting may require a specialised tool. In these cases, a user of the device may take the exterior sleeve 120 and the device to a vendor who will fit or remove the exterior sleeve using the specialised tool.

The exterior sleeve 120 comprises visual information, writing or branding. Some of this is included at the time of moulding the exterior sleeve 120. For example, silicone having a particular colour is used to mould the exterior sleeve. Typically, however, features such as writing and branding must be included in post-processing of the exterior sleeve. Such methods of post-processing are well-known in the art and include, for example, printing.

In some embodiments the exterior sleeve 120 is moulded as a single piece. However, in other embodiments the exterior sleeve 120 comprises two pieces and the pieces are connectable using a snap-fit connection. In such cases, the pieces comprise reciprocal grooves which are formed at the time of moulding the exterior sleeve 120.

The invention claimed is:

1. An aerosol-generating system, comprising:
an aerosol-generating device configured to heat an aerosol-forming substrate; and
an exterior sleeve,
wherein the aerosol-generating device comprises:
a device housing, and
a plurality of internal components contained within an interior space enclosed by the device housing,
wherein the device housing comprises an external surface and at least one bent or bendable portion, bent or bendable into or towards the interior space to interact with one of the internal components, and
wherein the exterior sleeve covers the at least one bent or bendable portion.

2. The aerosol-generating system according to claim 1, wherein the at least one bent or bendable portion comprises a bent portion comprising a tab defined by cuts in the external surface.

3. The aerosol-generating system according to claim 2,
further comprising a plurality of tabs formed in the external surface of the device housing,
wherein at least one tab forms a fixing element that is deflected into the interior space and engages an internal component to hold the internal component in place with respect to the device housing.

4. The aerosol-generating system according to claim 2, wherein at least one tab of the external surface of the device housing comprises a user interface element deflectable toward the interior space of the device housing.

5. The aerosol-generating system according to claim 4, wherein the exterior sleeve is configured such that the portion of the exterior sleeve covering the user interface element when the exterior sleeve covers the device housing is configured such that haptic input from a user of the aerosol-generating device on that portion will cause the user interface element to deflect towards the interior space of the device housing.

6. The aerosol-generating system according to claim 4, wherein the plurality of internal components comprises control circuitry configured to sense movement of the user interface element.

7. The aerosol-generating system according to claim 1, wherein the plurality of internal components contained within the device housing comprises at least one of a power supply, control circuitry, a heater assembly, or a receiving portion configured to receive an aerosol-generating article comprising the aerosol-forming substrate.

8. The aerosol-generating system according to claim 7,
wherein the plurality of internal components comprises a heater assembly, and
wherein the heater assembly is an inductive heating assembly.

9. The aerosol-generating system according to claim 7,
wherein the plurality of internal components comprises a heating assembly and a receiving portion, and
wherein the heating assembly is positioned to heat the aerosol-generating article when the aerosol-generating article is received in the receiving portion.

10. The aerosol-generating system according to claim 1, wherein the device housing is formed from a single piece of material.

11. The aerosol-generating system according to claim 1, wherein the exterior sleeve comprises a plurality of separate parts connected together.

12. A kit, comprising:
an aerosol-generating device configured to heat an aerosol-forming substrate; and
at least one exterior sleeve,
wherein the aerosol-generating device comprises:
a device housing, and
a plurality of internal components contained within an interior space enclosed by the device housing;
wherein the device housing is formed from a single piece of material and comprises an external surface and at least one bent or bendable portion, bent or bendable into or towards the interior space to interact with one of the internal components, and
wherein the at least one exterior sleeve is configured to removably cover the least one bent or bendable portion.

13. The kit according to claim 12, further comprising:
a first exterior sleeve and a second exterior sleeve,
wherein the first exterior sleeve comprises an external surface comprising visual information, writing, or other branding information, and
wherein the second exterior sleeve comprises an external surface comprising visual information, writing, or other branding information that is different from the visual information, writing, or other branding information of the external surface of the first exterior sleeve.

14. A method of manufacturing an aerosol-generating system, comprising steps of:
providing a device housing for containing a plurality of internal components within an interior space, the device housing comprising an external surface;
providing at least one bent or bendable portion in the device housing that is bent or bendable towards the interior space to interact with one of the internal components; and
providing an exterior sleeve to removably cover the at least one bent or bendable portion.

15. The method of manufacturing an aerosol-generating system according to claim 14, further comprising the step of:
fitting the exterior sleeve onto the device housing, wherein the step of providing at least one bent or bendable portion comprises:

cutting an external surface of the device housing to define a tab, and deflecting the tab into the interior space to engage an internal component to hold the internal component in place with respect to the device housing to form a fixing element.

* * * * *